US009038527B2

(12) United States Patent
Orihara et al.

(10) Patent No.: US 9,038,527 B2
(45) Date of Patent: May 26, 2015

(54) FLUID PRESSURE CYLINDER

(75) Inventors: Shun Orihara, Saitama-gun (JP); Yasunaga Suzuki, Kitakatsushika-gun (JP); Naoki Hoshi, Matsudo (JP); Hiroyuki Asahara, Tsukuba (JP)

(73) Assignee: SMC KABUSHIKI KAISHA, Tokyo (JP)

( * ) Notice: Subject to any disclaimer, the term of this patent is extended or adjusted under 35 U.S.C. 154(b) by 402 days.

(21) Appl. No.: 13/562,929

(22) Filed: Jul. 31, 2012

(65) Prior Publication Data

US 2013/0032027 A1 Feb. 7, 2013

(30) Foreign Application Priority Data

Aug. 4, 2011 (JP) ..... 2011-170888

(51) Int. Cl.
*F15B 15/14* (2006.01)
*F15B 15/20* (2006.01)

(52) U.S. Cl.
CPC ..... *F15B 15/20* (2013.01); *F15B 15/14* (2013.01)

(58) Field of Classification Search
CPC ..... F15B 15/222; F15B 15/223; F15B 15/224
USPC ..... 91/394, 409, 396
See application file for complete search history.

(56) References Cited

U.S. PATENT DOCUMENTS 64,972 A * 5/1867 Grimshaw ..... 91/394
3,296,942 A * 1/1967 Nelson ..... 91/409
3,608,437 A * 9/1971 Little et al. ..... 92/85 R
4,167,134 A * 9/1979 Yuda ..... 91/405
6,553,889 B2 * 4/2003 Migliori ..... 91/394
7,836,816 B2 * 11/2010 Tokumoto ..... 92/165 R

FOREIGN PATENT DOCUMENTS

JP 59-126104 7/1984
JP 59-205008 11/1984
JP 2-18804 5/1990
JP 2912410 4/1999
JP 2005-240936 9/2005

OTHER PUBLICATIONS

"3 Fingers Air Chuck MHS3 series Parallel opening/closing type ø32, ø40, ø50, ø63, Newly available Short, Compact Design", Catalouge No. CAT.S20-104 A, SMC Kabushiki Kaisha, Mar. 10, 1994, First Edition, with Partial English Translation, 4 pages.

* cited by examiner

*Primary Examiner* — Nathaniel Wiehe
*Assistant Examiner* — Dustin T Nguyen
(74) *Attorney, Agent, or Firm* — Oblon, McClelland, Maier & Neustadt, L.L.P.

(57) ABSTRACT

In a fluid pressure cylinder, a piston is displaced in an axial direction under the action of a pressure fluid. A circular protrusion, which projects toward the piston along an axial direction of the cylinder tube, is formed on an inner end surface of a collar member constituting part of the fluid pressure cylinder, a concavity, which can be fitted externally over the circular protrusion, is formed on the piston, and an annular groove is formed on an inner circumferential edge of an end plate. By the piston coming into contact with the end plate, a pressure receiving chamber is formed between the piston and the annular groove, together with an opening of a second port on an inner side of the cylinder tube being closed to a maximum of 90%.

2 Claims, 7 Drawing Sheets

FLUID PRESSURE CYLINDER

CROSS-REFERENCE TO RELATED APPLICATION

This application is based upon and claims the benefit of priority from Japanese Patent Application No. 2011-170888 filed on Aug. 4, 2011, of which the contents are incorporated herein by reference.

BACKGROUND OF THE INVENTION

1. Field of the Invention

The present invention relates to a fluid pressure cylinder in which a piston is displaced in an axial direction under the action of a pressure fluid.

2. Description of the Related Art

Heretofore, fluid pressure cylinders have widely been used as workpiece transport means, or as operating means for positioning or operating various types of industrial machinery.

In general, in a fluid pressure cylinder, a piston disposed in the interior of a cylinder tube is displaced along an axial direction by a pressure fluid, which is supplied from a fluid supply port, and transporting and positioning, etc., of a workpiece is carried out through a piston rod, which is coupled to the piston. (See, Japanese Laid-Open Patent Publication No. 2005-240936.)

Concerning such cylinders, in recent years, techniques have been sought for reducing the size and scale of fluid pressure cylinders, and in particular, for shortening the length along the axial direction (i.e., the overall length of the fluid pressure cylinder) under a condition in which the stroke length of the piston (piston stroke) is maintained.

SUMMARY OF THE INVENTION

With the fluid pressure cylinder according to Japanese Laid-Open Patent Publication No. 2005-240936, at times when displacement of the piston is initiated and stopped, inertial forces tend to act on the workpiece. Consequently, as a result of such inertial forces, depending on the type of workpiece or the like, the position of the workpiece may become shifted with respect to the piston rod, resulting in reduced positioning accuracy.

For overcoming this kind of defect, a flow rate adjustment valve is used. More specifically, when initiation of displacement and stopping of the piston is carried out, the flow rate of the pressure fluid supplied to the interior of the cylinder tube and/or the flow rate of pressure fluid discharged from the cylinder tube is adjusted by the flow rate adjusting valve, whereby the inertial force that acts on the workpiece can be suppressed.

However, in addition to the increased cost required to incorporate such a flow rate adjustment valve therein, there is a concern that control of the flow rate adjustment valve, etc., may lead to complications.

The present invention has been conceived of to address the aforementioned problems. An object of the present invention is to provide a fluid pressure cylinder, which without using a flow rate adjustment valve or the like, is capable of suppressing inertial forces that act on the workpiece and thus can increase the accuracy with which a workpiece is positioned, while also enabling the overall length of the fluid pressure cylinder to be shortened under a condition in which the stroke length of the piston is maintained.

According to a first aspect of the present invention, a fluid pressure cylinder is provided characterized by a piston disposed displaceably in the interior of a cylinder tube, a piston rod connected to the piston, a first closure member for closing one end opening of the cylinder tube with the piston rod inserted therethrough, a second closure member inserted into another end opening of the cylinder tube for closing the other end opening, and a first port and a second port that open on an inner circumferential wall of the cylinder tube and through which a pressure fluid flows. A circular protrusion, which projects toward the piston along an axial direction of the cylinder tube, is formed on an inner end surface of the first closure member, a concavity, which can be fitted externally over the circular protrusion, is formed on the piston, and an annular groove is formed on an inner circumferential edge of the second closure member. By the piston coming into contact with the second closure member, a pressure receiving chamber is formed between the piston and the annular groove, together with an opening of the second port on an inner side of the cylinder tube being closed to a maximum of 90%.

According to the first aspect of the present invention, under a condition in which the piston contacts the second closure member, for example, if pressure fluid is supplied to the second port from a pressure fluid supply source, the pressure fluid flows into the pressure receiving chamber while the flow rate thereof is throttled appropriately at the opening on the second port on the inner side of the cylinder tube. Owing thereto, the flow rate at which pressure fluid flows into the pressure receiving chamber can suitably be reduced, and therefore the acceleration of the piston can be reduced as well. Thus, when displacement of the piston toward the side of the first closure member is initiated, inertial forces acting on the workpiece can be suppressed even though a flow rate adjustment valve is not used.

Further, when the piston is displaced toward the side of the first closure member under the action of the pressure fluid introduced from the second port, the circular protrusion of the first closure member enters into the concavity of the piston and the concavity is externally fitted over the circular protrusion. Owing thereto, the fluid (pressure fluid) introduced into the first port is throttled by a gap formed between the circular protrusion and the concavity, and therefore, the pressure of the fluid existing between the piston and the first closure member increases and the piston is decelerated. Thus, when movement of the piston is halted at the side of the first closure member, inertial forces acting on the workpiece can be suppressed even though a flow rate adjustment valve is not used.

Furthermore, when the piston is displaced toward the side of the second closure member under the action of the pressure fluid introduced from the first port, the opening of the second port on the inner side of the cylinder tube gradually becomes covered by the piston. Owing thereto, the fluid (pressure fluid) introduced into the second port is throttled by the opening, and therefore, the pressure of the fluid existing between the piston and the second closure member increases and the piston is gradually decelerated. Thus, when movement of the piston is halted at the side of the second closure member, inertial forces acting on the workpiece can be suppressed even though a flow rate adjustment valve is not used.

Further still, because the concavity formed on the piston is capable of being externally fitted over the circular protrusion formed on the first closure member, the total length of the fluid pressure cylinder can be shortened while the stroke length of the piston is maintained.

In a second aspect of the present invention, by the piston coming into contact with the circular protrusion, another pressure receiving chamber is formed between the piston and the first closure member, together with an opening of the first port on the inner side of the cylinder tube being closed to a maximum of 90%.

According to the second aspect of the present invention, when movement of the piston is initiated to the side of the second closure member, inertial forces acting on the workpiece can be suppressed even though a flow rate adjustment valve is not used. Further, when the piston is displaced toward the side of the first closure member by the pressure fluid flowing into the interior of the cylinder tube from the second port, because the opening of the first port gradually becomes covered by the piston, inertial forces acting on the workpiece can also be suppressed when movement of the piston is halted at the side of the first closure member.

In a third aspect of the present invention, in the fluid pressure cylinder noted above in relation to the second aspect, in a condition in which the piston contacts the second closure member, the opening of the second port on the inner side of the cylinder tube is 70% closed, and in a condition in which the piston contacts the circular protrusion, the opening of the first port on the inner side of the cylinder tube is 70% closed.

According to the third aspect of the present invention, in a state in which the piston contacts the second closure member, 30% of the opening of the second port on the inner side of the cylinder chamber communicates with the pressure receiving chamber, and in a state in which the piston contacts the circular protrusion, 30% of the opening of the first port on the inner side of the cylinder chamber communicates with the pressure receiving chamber. Therefore, the length in the axial direction of the fluid pressure cylinder can be reduced as much as possible, contributing to further miniaturization of the fluid pressure cylinder, together with preventing foreign matter such as grease or the like from blocking the communicating regions.

As described above, according to the present invention, because the pressure fluid, which is introduced to the second port from the fluid pressure supply source, flows into the pressure receiving chamber while the flow rate thereof is throttled appropriately at the opening of the second port on the inner side of the cylinder tube, when displacement of the piston toward the side of the first closure member is initiated, acceleration of the piston can be reduced. Further, when movement of the piston is halted at the side of the first closure member, because the fluid delivered into the first port is throttled by the gap between the circular protrusion and the concavity, the piston can be decelerated. Furthermore, when movement of the piston is halted at the side of the second closure member, because the opening of the second port on the inner side of the cylinder tube is gradually covered by the piston, the piston can gradually be decelerated. More specifically, even though a flow rate adjusting valve is not used, inertial forces acting on the workpiece can be suppressed, and thus positioning of the workpiece can be carried out with high accuracy. Moreover, because the concavity can be fitted externally over the circular protrusion, the total length of the fluid pressure cylinder can be shortened while the stroke length of the piston is maintained.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of a fluid pressure cylinder according to the present invention will be described in detail below with reference to the accompanying drawings.

Figure 1:
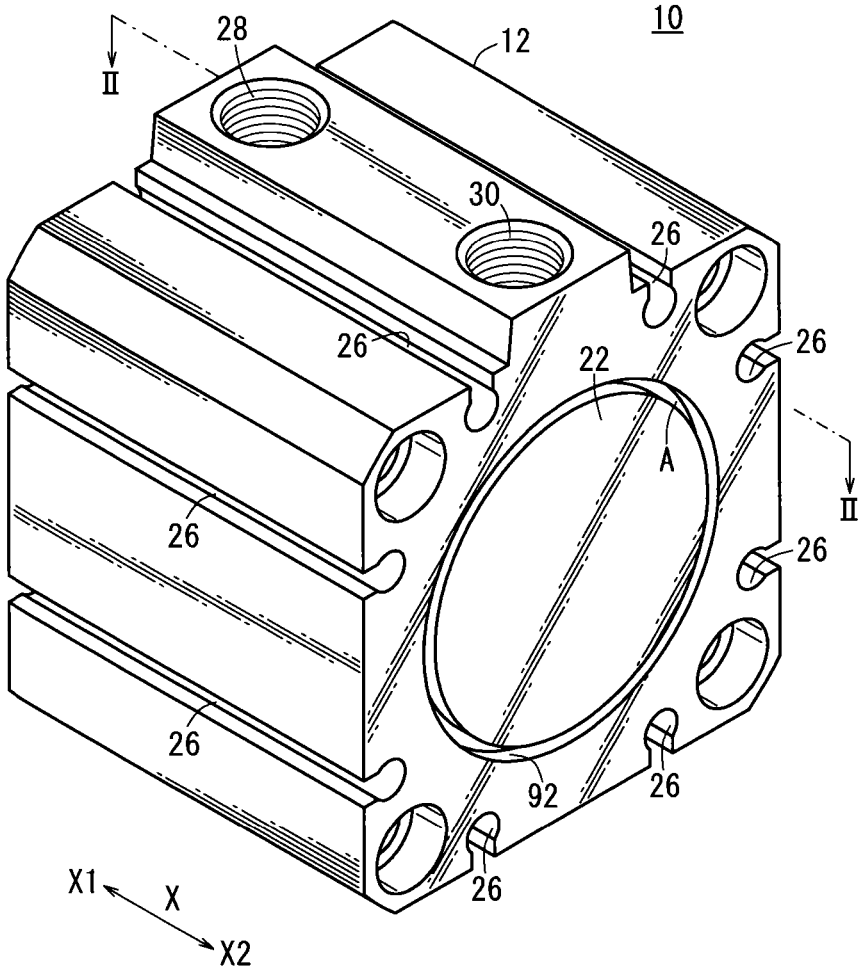
FIG. 1 is an exterior perspective view of a fluid pressure cylinder according to the present invention.
Figure 2:
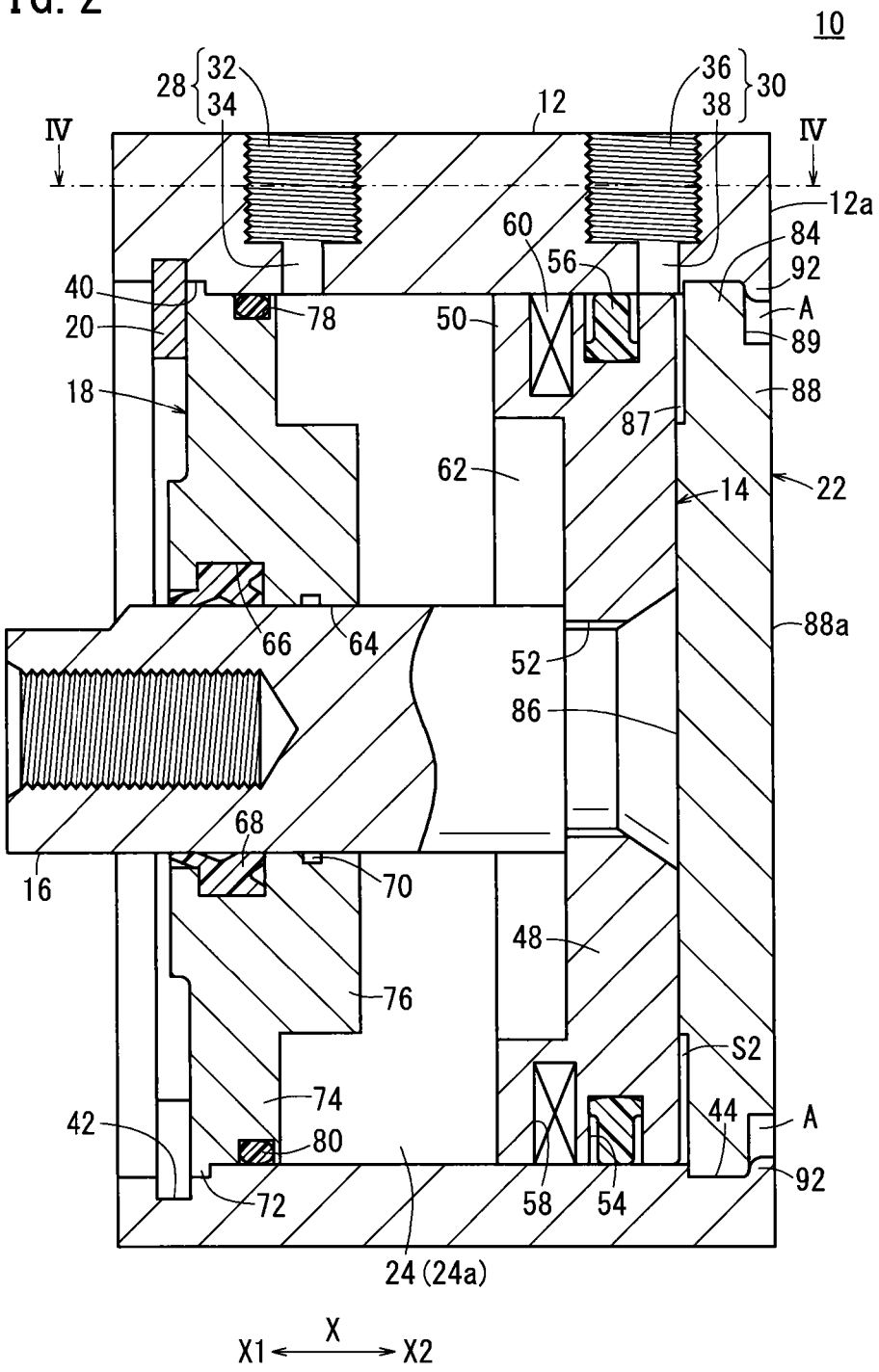
FIG. 2 is a cross sectional view taken along line II-II of FIG. 1.

As shown in FIGS. 1 and 2, a fluid pressure cylinder 10 is equipped with a tubular shaped cylinder tube 12 substantially in the shape of a rectangular parallelepiped, a piston 14 slidably disposed in the interior of the cylinder tube 12, a piston rod 16 connected to the piston 14, a collar member (first closure member) 18 that closes a front end opening (an opening in the direction of the arrow X1) of the cylinder tube 12, a retaining ring 20 for preventing movement of the collar member 18 in the direction of the arrow X1, and an end plate (second closure member) 22 that closes a rear end opening (an opening in the direction of the arrow X2) of the cylinder tube 12.

A cylinder chamber 24 is formed by the inner end surface of the collar member 18, the inner end surface of the end plate 22, and the inner circumferential surface of the cylinder tube 12 (see FIG. 2). The structure of the collar member 18 will be explained later.

The cylinder tube 12 is constituted from a metal material such as an aluminum alloy or the like. On the outer circumferential surface thereof, plural sensor grooves 26 (eight as shown in FIG. 1) extend along the axial direction (the direction of the arrow X) of the cylinder tube 12, in which non-illustrated sensors (magnetic sensors) capable of detecting the position of the piston may be installed.

Figure 3:
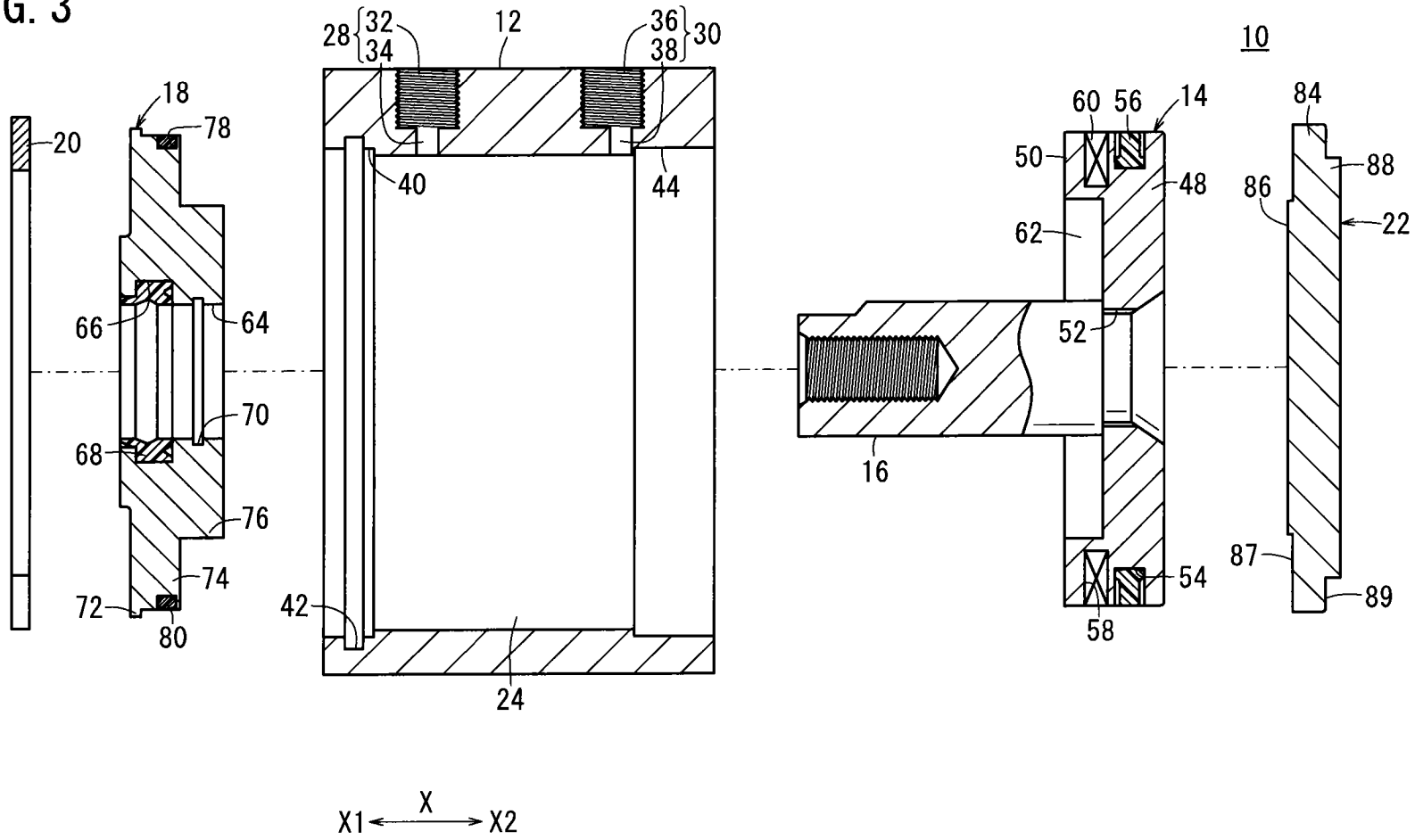
FIG. 3 is an exploded perspective view of the fluid pressure cylinder according to the present invention.

As shown in FIGS. 2 and 3, a first port 28, which is positioned somewhat more in the direction of the arrow X1 from the center of the cylinder tube 12, and a second port 30, which is positioned in the vicinity of the end in the direction of the arrow X2, are formed in the cylinder tube 12.

The first port 28 includes a first connection hole 32 with threaded grooves engraved therein, and a first communication hole 34 that communicates with the first connection hole 32 and which opens on the inner circumferential surface of the cylinder tube 12. The central axes of the first connection hole 32 and the first communication hole 34 are substantially coaxial.

The second port 30 includes a second connection hole 36 with threaded grooves engraved therein, and a second communication hole 38 that communicates with the second connection hole 36 and which opens on the inner circumferential surface of the cylinder tube 12. The central axis of the second communication hole 38 is offset in the direction of the arrow X2 from the central axis of the second connection hole 36.

The size of the second connection hole 36 is set substantially the same as the size of the first connection hole 32, and the size of the second communication hole 38 is set substantially the same as the size of the first communication hole 34.

In this case, a non-illustrated external device is connected to the first connection hole 32 and the second connection hole 36 for supplying a pressure fluid, for example, pressurized air, thereto.

On the inner circumferential surface of the cylinder tube 12, on the end in the direction of the arrow X1, a first groove 40 for installation therein of the collar member 18, and a second groove 42 for installation therein of the retaining ring 20 are formed respectively in annular shapes. The retaining ring is a C-shaped member which is used to prevent the collar member 18 from moving in the axial direction.

Further, on the inner circumferential surface of the cylinder tube 12, on the end in the direction of the arrow X2, a third groove 44 for installation therein of the end plate 22 is formed. The groove depth of the first and third grooves 40, 44 is set substantially the same for both grooves.

The piston 14 is provided in the interior of the cylinder chamber 24 so as to be displaceable along the directions of the arrows X1 and X2. Consequently, the cylinder chamber 24 is divided into a first cylinder chamber 24*a* that communicates with the first port 28, and a second cylinder chamber 24*b* that communicates with the second port 30 (see FIG. 5).

Further, the piston 14 includes a piston main body 48 formed in a disk shape, and an annular protrusion 50 that projects toward the side of the collar member 18 from one end surface (back surface) of the piston main body 48.

The outer circumferential edge of the piston main body 48 is chamfered, and together therewith, in the center of the piston main body 48, a through hole 52 is formed that penetrates in the axial direction.

One end of the piston rod 16 is inserted through the through hole 52, and the piston main body 48 and the piston rod 16 are joined together integrally. The other end of the piston rod 16 penetrates through the collar member 18 and extends outward from the cylinder tube 12. A piston packing 56, which is made of resin or the like, is mounted in an annular groove 54 provided in the piston main body 48, and a magnetic body 60 is mounted in an annular groove 58 provided on the annular protrusion 50. The magnetic body 60 is disposed at a position so as not to block the first communication hole 34. By formation of the annular protrusion 50, a concavity 62 is formed in the one end side of the piston main body 48.

The collar member 18, for example, is constructed from a metal material such as an aluminum alloy or the like, and has an insertion hole 64 formed therein through which the piston rod 16 penetrates along the axial center.

The insertion hole 64 expands in diameter on the side of the retaining ring 20, and an annular groove 66 is formed therein. A rod packing 68 made of resin or the like is mounted in the annular groove 66. On the other hand, on the end plate 22 side of the insertion hole 64, an oil pocket 70 is formed therein for storing a lubricating oil in the collar member 18.

The collar member 18, which is constructed in the foregoing manner, also includes a large diameter portion 72 mounted in the first groove 40 of the cylinder tube 12, an intermediate diameter portion 74 in contact with the inner circumferential surface of the cylinder tube 12, and a small diameter portion (circular protrusion) 76 joined continuously with the intermediate diameter portion 74 and which can be fitted into the concavity 62 of the piston 14.

In this case, the diameter of the small diameter portion 76 is slightly smaller than the diameter of the concavity 62, and the axial length of the small diameter portion 76 is longer than the depth of the concavity 62. An O-ring 80 made of resin or the like is mounted in an annular groove 78 provided in the collar member 18.

The end plate 22 is constructed, for example, from a metal material such as an aluminum alloy or the like, and includes an end plate main body 84 mounted in the aforementioned third groove 44, a first projection 86 that projects toward the side of the collar member 18 from one end surface of the end plate main body 84, and a second projection 88 that projects outwardly from another end surface of the end plate main body 84. The end plate main body 84, the first projection 86, and the second projection 88 are formed integrally and make up a disk shape as a whole.

Further, in a condition in which the end plate 22 is inserted and arranged in the cylinder tube 12 via the rear end opening of the cylinder tube 12, the one end of the cylinder tube 12 is caulked or crimped, thereby fixing the end plate 22 in the cylinder tube 12. At this time, an overhanging part 92, which projects in a radial inward direction from the third groove 44, is formed in an annular shape. In addition, as can be appreciated from FIG. 5, a gap A is formed between the outer circumferential surface of the second projection 88 and the overhanging part 92.

By formation of the first projection 86, an annular groove 87 is formed on one end surface of the end plate main body 84, and by formation of the second projection 88, another annular groove 89 is formed on the other end surface of the end plate main body 84.

The outer diameters of the first and second projections 86, 88 can be set arbitrarily. In the present embodiment, for example, the outer diameter of the first projection 86 is set substantially equivalent to the outer diameter of the small diameter portion 76, and the outer diameter of the second projection 88 is set smaller than the inner diameter of the cylinder tube 12 and larger than the outer diameter of the first projection 86.

The amount by which the first projection 86 projects in the axial direction is set to be smaller than the hole diameter of the second communication hole 38. More specifically, the amount by which the first projection 86 projects is set, for example, to a size on the order of about ⅓ the inner diameter of the second communication hole 38. For example, the amount by which the first projection 86 projects preferably is set to substantially the same size as the difference between the amount by which the small diameter portion 76 projects and the amount by which the annular projection 50 projects. Further, although the amount by which the second projection 88 projects can be set arbitrarily, preferably, the amount of projection is of an order such that, upon completion of assembly, the second projection 88 lies substantially flush with an end surface 12*a* of the cylinder tube 12. More specifically, the amount by which the second projection 88 projects may be set such that, upon completion of assembly, an outer end surface 88*a* of the second projection 88 is positioned slightly inward (toward the side of the piston 14) from the end surface 12*a* of the cylinder tube 12.

With the fluid pressure cylinder 10 constructed in the foregoing manner, in a condition in which the piston 14 contacts the inner end surface of the small diameter portion 76 of the collar member 18 (i.e., in the state shown in FIG. 5, hereinafter referred to as a "first state"), a space (pressure receiving chamber) S1 is formed as a region surrounded by the inner end surface of the intermediate diameter portion 74, the outer circumferential surface of the small diameter portion 76, the rear surface of the piston main body 48, the inner circumferential surface of the annular protrusion 50, the inner end surface of the annular protrusion 50, and the inner circumferential surface of the cylinder tube 12.

Figure 4:
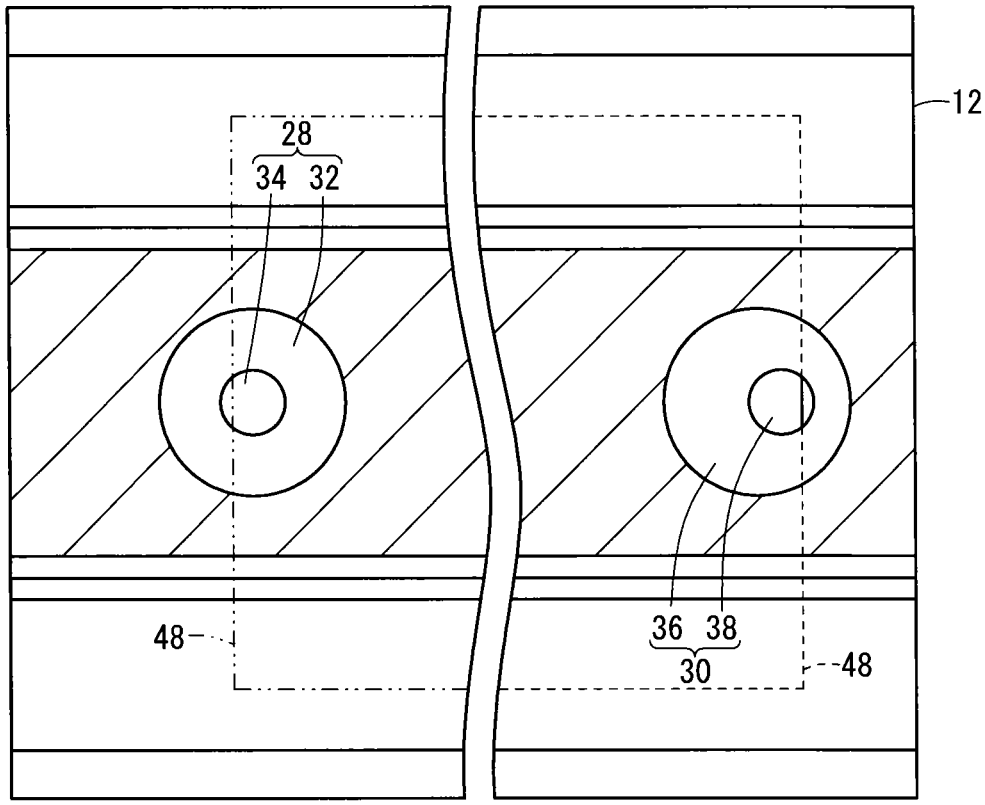
FIG. 4 is a cross sectional view taken along line IV-IV of FIG. 2.

In addition, as shown in FIG. 4, the first communication hole 34 faces the outer circumferential surface of the piston 14, and is blocked up to a maximum of 90% by the outer circumferential surface of the piston 14. Owing thereto, the flow amount of pressure fluid flowing into the space S1 (first cylinder chamber 24*a*), and the amount of pressure fluid that flows out from the first cylinder chamber 24*a* can be throttled or constricted to a suitable degree by the open portion of the first communication hole 34.

Preferably, the first communication hole 34 is blocked 70% by the outer circumferential surface of the piston 14. Consequently, in the first state, because the first communication hole 34 communicates through 30% of the opening to the space S1, the length in the axial direction of the fluid pressure cylinder 10 can be reduced, thereby minimizing the scale of the fluid pressure cylinder 10 as much as possible, while still preventing foreign matter such as grease or the like from blocking the portion of the opening of the first communication hole 34 that remains in communication with the space S1.

On the other hand, in a condition in which the piston 14 contacts the inner end surface of the first projection 86 (i.e., the state shown in FIG. 2, hereinafter referred to as a "second state"), a space (pressure receiving chamber) S2 is formed by the upper end surface of the piston 14, the outer circumferential surface of the first projection 86, the inner end surface of the end plate main body 84, and the inner circumferential surface of the cylinder tube 12. The volume (cubic capacity) of the space S2 is set to be larger than the volume (cubic capacity) of the space S1.

In addition, the second communication hole 38 faces the outer circumferential surface of the piston 14, and is blocked up to a maximum of 90% by the outer circumferential surface of the piston 14. Owing thereto, the flow amount of pressure fluid flowing into the space S2 (second cylinder chamber 24*b*), and the amount of pressure fluid that flows out from the second cylinder chamber 24*b* can be throttled or constricted to a suitable degree by the open portion of the second communication hole 38.

Preferably, the second communication hole 38 is blocked 70% by the outer circumferential surface of the piston 14. Consequently, in the second state, because the second communication hole 38 communicates through 30% of the opening to the space S2, the length in the axial direction of the fluid pressure cylinder 10 can be reduced, thereby minimizing the scale of the fluid pressure cylinder 10 as much as possible, while still preventing foreign matter such as grease or the like from blocking the portion of the opening of the second communication hole 38 that remains in communication with the space S2.

As described above, with the present embodiment, between the overhanging part 92 and the outer circumferential surface of the second projection 88, a gap A is formed, and the overhanging part 92 is formed by caulking one end of the cylinder tube 12. Therefore, even without providing a seal member, a desired sealing capability can reliably be assured. Thus, since the number of parts can be reduced, manufacturing costs for the fluid pressure cylinder 10 can be reduced as well.

Further, by installing a non-illustrated ring member in the gap A, positioning of the fluid pressure cylinder 10 can easily be performed.

Furthermore, because the outer end surface 88*a* of the second projection 88 is shifted slightly more in the direction of the arrow X1 (toward the side of the piston 14) than the end surface 12*a* of the cylinder tube 12, compared to a case of caulking the end plate 22 to the cylinder tube 12 such that the outer end surface 88*a* of the second projection 88 is positioned more in the direction of the arrow X2 than the end surface 12*a* of the cylinder tube 12, the total length of the fluid pressure cylinder 10 in the direction of the arrow X can be shortened.

Next an explanation will be made concerning operations and effects of the fluid pressure cylinder 10 according to the present invention.

In the second state, in a condition in which the first port 28 is open to atmosphere, when a pressure fluid (e.g., pressurized air) is supplied to the second connection hole 36 from a non-illustrated pressure fluid supply source, the pressure fluid flows into the space S2 (second cylinder chamber 24*b*) at the opening of the second communication hole 38 on the inner side of the cylinder tube 12 while the flow rate is throttled appropriately (e.g., on the order of 30%).

In addition, under an action of the pressure fluid directed into the space S2, the piston 14 is displaced in the direction of the arrow X1 (toward the front end side). At this time, acceleration of the piston 14 is proportional to the rate at which the pressure fluid flows into the space S2, and therefore, when supply of the pressure fluid is initiated, acceleration of the piston 14 is suitably small. In other words, abrupt flying off of the piston 14 toward the one end side is suppressed.

As the piston 14 moves in the direction of the arrow X1, the area ratio of the opening of the second communication hole 38 that communicates with the second cylinder chamber 24*b* gradually becomes larger, or stated otherwise, the communicating area of the opening of the second communication hole 38 with respect to the second cylinder chamber 24*b* gradually increases. Therefore, the rate at which the pressure fluid flows into the second cylinder chamber 24*b* (inflow rate per unit time) gradually increases, and as a result, the acceleration of the piston 14 rises.

Subsequently, the entire opening of the second communication hole 38 becomes exposed to the second cylinder chamber 24*b*, and the piston 14 is displaced in the direction of the arrow X1 at a constant velocity.

Thereafter, when the concavity 62 of the piston 14 is fitted over the small diameter portion 76 of the collar member 18, because the flow rate of the fluid directed into the first communication hole 34 is limited (made small) due to the gap created between the annular protrusion 50 and the small diameter portion 76, the fluid pressure inside the concavity 62 progressively increases. Consequently, since the displacement operation of the piston 14 is constrained, the piston 14 gradually decelerates. Stated otherwise, the fluid inside the concavity 62 acts to carry out a cushioning effect (air cushion effect) on the piston 14.

Next, as the piston 14 is further displaced in the direction of the arrow X1 while decelerating, the opening of the first communication hole 34 on the inner side of the cylinder tube 12 gradually becomes covered by the annular protrusion 50. As a result, since the fluid inside the first cylinder chamber 24*a* that is guided into the first communication hole 34 is throttled or constricted by the opening of the first communication hole 34, the pressure of the fluid inside the first cylinder chamber 24*a* becomes higher, and the piston 14 is further decelerated.

Figure 5:
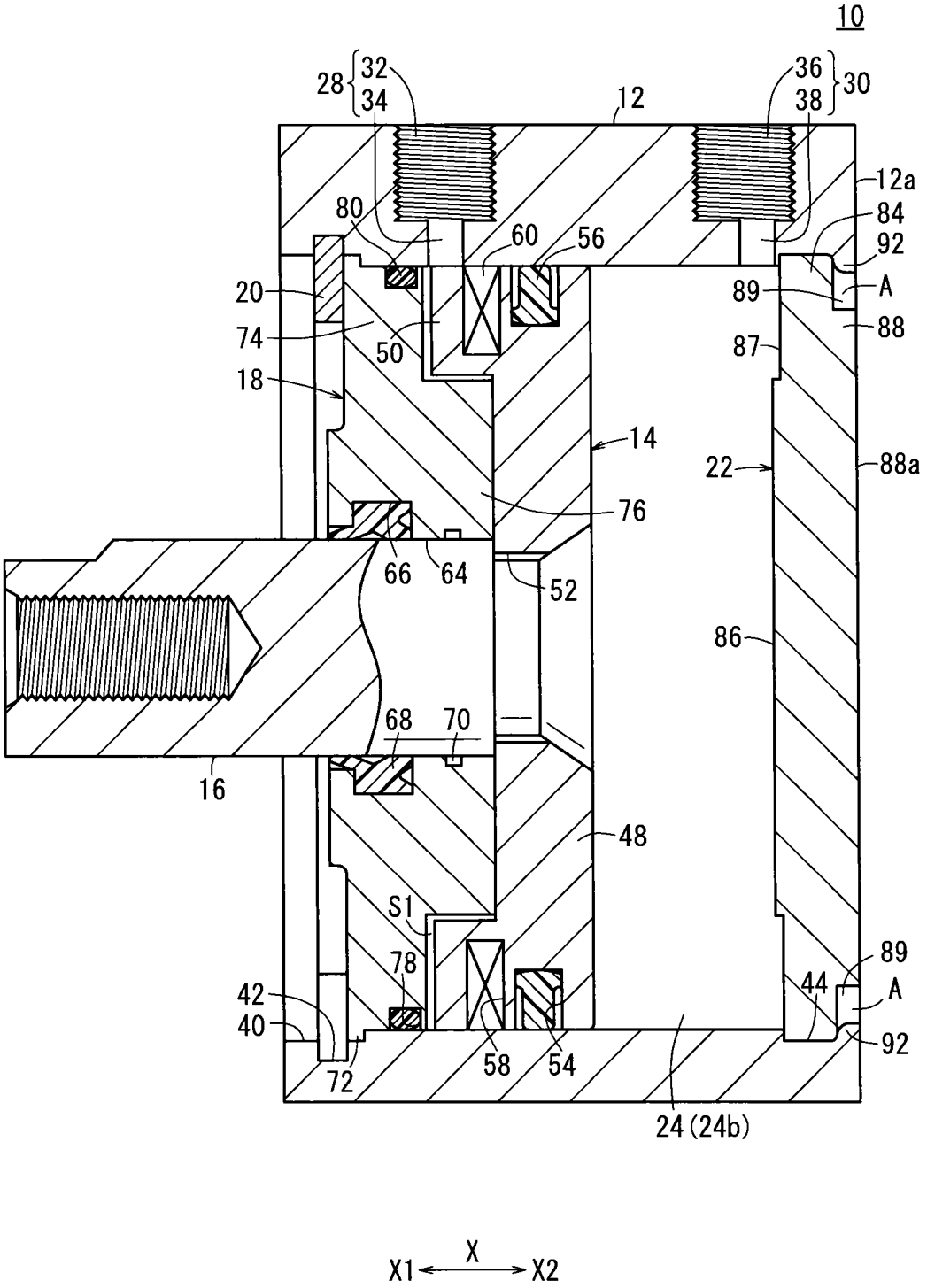
FIG. 5 is a cross sectional view showing a condition in which a piston is displaced to a rod end side.

In addition, when the wall that forms the concavity 62 of the piston main body 48 contacts the inner end surface of the small diameter portion 76, the piston 14 is stopped, and the first state is brought about (see FIG. 5). At this time, a space S1 is formed between the piston 14 and the collar member 18, together with a portion (e.g., 70%) of the opening of the first communication hole 34 being covered by the annular protrusion 50.

On the other hand, when supply of the pressure fluid is switched from the second port 30 to the first port 28 under a switching action of a non-illustrated switching valve, pressure fluid from the aforementioned pressure fluid supply source is supplied to the first connection hole 32, whereupon the pressure fluid flows into the space S1 (first cylinder chamber 24*a*) while the flow rate of the pressure fluid is throttled to a suitable degree (for example, 30%) at the opening of the first communication hole 34 on the inner side of the cylinder tube 12.

In addition, under an action of the pressure fluid directed into the space S1, the piston 14 is displaced in the direction of the arrow X2 (toward the rear end side). At this time, acceleration of the piston 14 is proportional to the rate at which the pressure fluid flows into the space S1, and therefore, when displacement of the piston 14 is initiated, acceleration of the piston 14 is suitably small.

In this case, because the volume of the space S1 is set to be smaller than the volume of the space S2, the acceleration of the piston 14 at the time that displacement toward the side of the end plate 22 is initiated becomes greater than the acceleration of the piston 14 at the time that displacement toward the side of the collar member 18 is initiated.

As the piston 14 continues to move in the direction of the arrow X2, the area ratio of the opening of the first communication hole 34 that communicates with the first cylinder chamber 24*a* gradually becomes larger, or stated otherwise, the communicating area of the opening of the first communication hole 34 with respect to the first cylinder chamber 24*a* gradually increases. Therefore, the rate at which the pressure fluid flows into the first cylinder chamber 24*a* (inflow rate per unit time) gradually increases, and as a result, the piston 14 is gradually accelerated.

Then, the entire opening of the first communication hole 34 becomes exposed to the first cylinder chamber 24*a*, and the piston 14 is displaced in the direction of the arrow X2 at a constant velocity.

Thereafter, by the piston 14 being displaced in the direction of the arrow X2, the opening of the second communication hole 38 on the inner side of the cylinder tube 12 becomes gradually covered by the piston 14. As a result, since the fluid inside the second cylinder chamber 24*b* that is guided into the second communication hole 38 is throttled or constricted by the opening of the second communication hole 38, the pressure of the fluid inside the second cylinder chamber 24*b* becomes higher, and the piston 14 is decelerated.

In addition, when the upper surface of the piston main body 48 contacts the inner end surface of the first projection 86, the piston 14 is stopped and the second state is restored. In this manner, the piston 14 accommodated in the cylinder chamber 24 can be moved reciprocally along the axial direction.

As discussed above, using the fluid pressure cylinder 10 according to the present embodiment, at times when movement of the piston 14 is initiated (at initiation of workpiece displacement) and when the movement of the piston 14 is stopped (when the workpiece is stopped), inertial forces acting on the workpiece can suitably be suppressed. Consequently, positioning accuracy of the workpiece can be improved, even though a flow rate adjustment valve or the like, which is capable of adjusting the flow rate of the pressure fluid flowing into the cylinder chamber 24, is not used.

With the fluid pressure cylinder 10 according to the present invention, upon displacement of the piston 14 in the direction of the arrow X1, because the concavity 62 can be externally fitted over the small diameter portion 76, compared to a case in which the concavity 62 and the small diameter portion 76 are not provided, the total length of the fluid pressure cylinder 10 can be shortened while the stroke length of the piston 14 is maintained.

MODIFIED EXAMPLE

Figure 6:
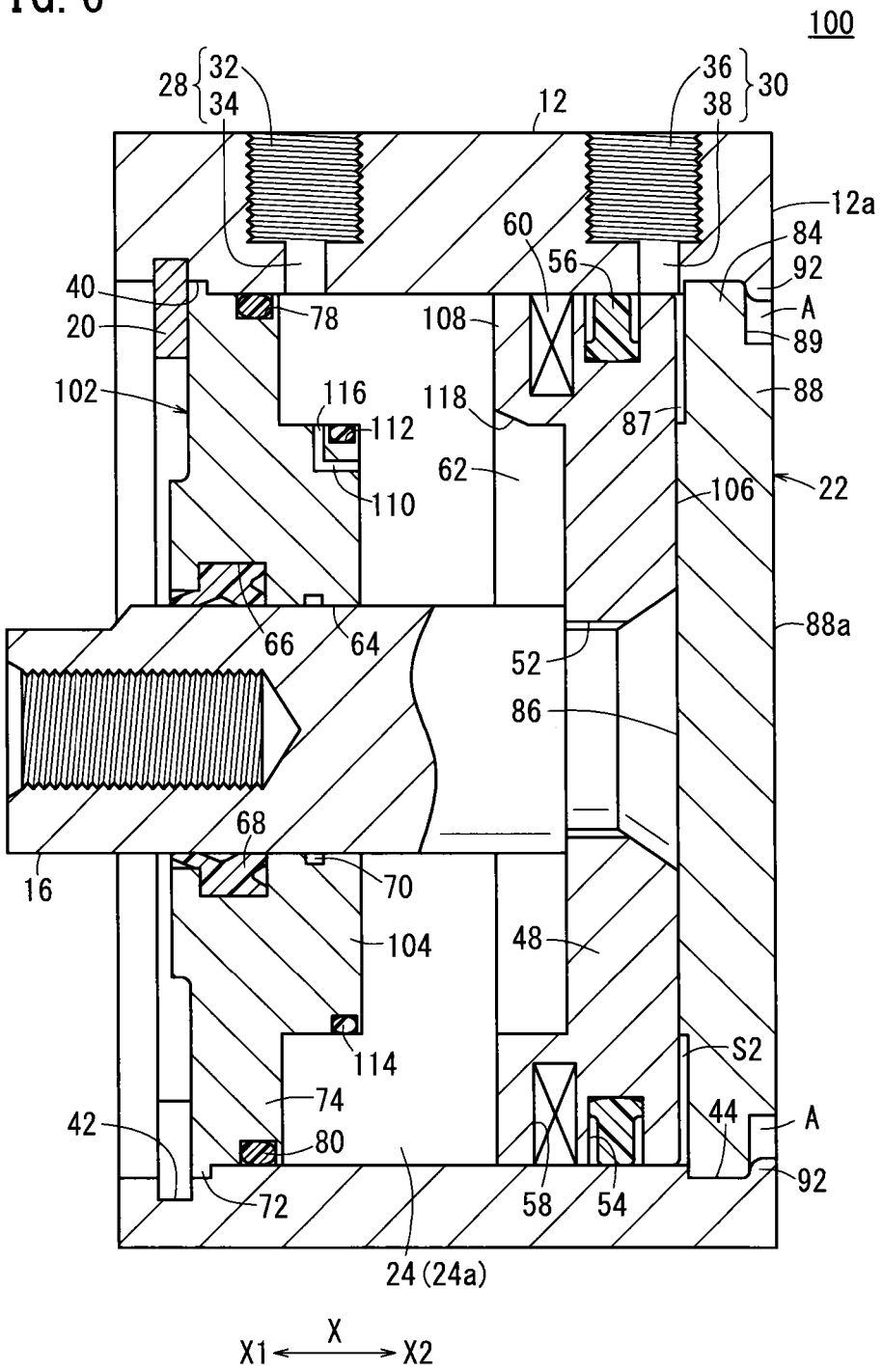
FIG. 6 is a cross sectional view of a fluid pressure cylinder according to a modified example of the present invention.
Figure 7:
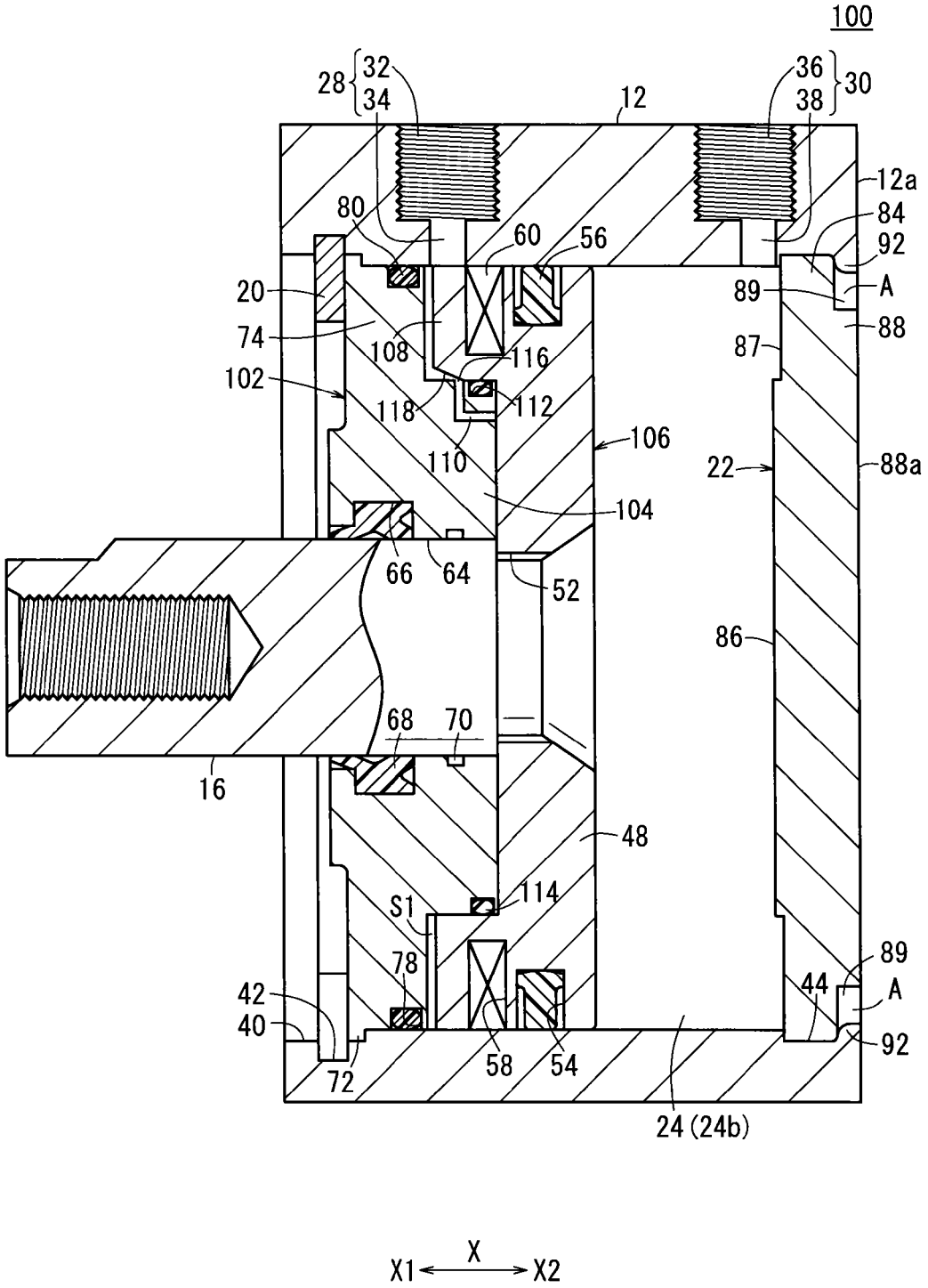
FIG. 7 is a cross sectional view showing a condition in which a piston is displaced to a rod end side, in the fluid pressure cylinder shown in FIG. 6.

Next, with reference to FIGS. 6 and 7, a description shall be given of a fluid pressure cylinder 100 according to a modified example. Constituent elements of the modified example, which are the same as those of the above-discussed embodiment, are denoted by the same reference characters and duplicate descriptions of such features are omitted.

As shown in FIG. 6, the fluid pressure cylinder 100 according to the present modified example differs in relation to the structure of a small diameter portion 104 constituting a collar member 102, and the structure of the annular protrusion 108 of a piston 106. More specifically, a bypass hole 110 is formed in an end surface (i.e., a surface that confronts the piston main body 48) of the small diameter portion 104, and an O-ring 114 made of resin or the like is installed in an annular groove 112 formed on the outer circumferential surface of the small diameter portion 104. The bypass hole 110 opens at a region on the outer circumferential surface of the small diameter portion 104, which is more proximate to the side of the intermediate diameter portion 74 than the annular groove 112.

Further, on the inner circumferential surface of an annular protrusion 108 at a region thereof confronting an opening 116 of the bypass hole 110, a tapered portion 118 is formed, which widens diametrically outward in the direction of the arrow X1.

With the fluid pressure cylinder 100 according to the modified example, when a pressure fluid is supplied to the second connection hole 36 to thereby cause displacement of the piston 106 in the direction of the arrow X1, the concavity 62 of the piston 106 is fitted over the small diameter portion 104 of the collar member 102. At this time, at a stage when such fitting begins, by means of a gap formed between the annular protrusion 108 and the small diameter portion 104 as well as the bypass hole 110, the flow rate of the fluid that is directed into the first communication hole 34 is restricted and the piston 106 is gradually decelerated.

In addition, as shown in FIG. 7, upon further displacement of the piston 106 in the direction of the arrow X1, because the O-ring 114 comes into sliding contact with the inner circumferential surface of the annular protrusion 108 and flow of fluid through the aforementioned gap is blocked, or stated otherwise, because the fluid inside the concavity 62 of the piston 106 can flow only through the bypass hole 110, the flow rate of the fluid directed into the first communication hole 34 is further restricted. Consequently, the piston 106 is decelerated even more. In other words, the bypass hole 110 acts to carry out a cushioning effect (air cushion effect) on the piston 106. Moreover, at this time, the fluid introduced from the opening 116 is guided suitably by the tapered portion 118 into the gap between the annular protrusion 108 and the intermediate diameter portion 74.

The present invention is not limited to the aforementioned embodiments, and it is a matter of course that various additional or modified structures could be adopted therein without deviating from the essence and gist of the present invention.

What is claimed is:

1. A fluid pressure cylinder, comprising:

a piston disposed displaceably in the interior of a cylinder tube;

a piston rod connected to the piston;

a first closure member for closing one end opening of the cylinder tube with the piston rod inserted therethrough;

a second closure member inserted into another end opening of the cylinder tube for closing the other end opening; and a first port and a second port that open to the interior of the cylinder tube on an inner circumferential wall of the cylinder tube and through which a pressure fluid flows to move the piston along an axial direction of the cylinder tube, wherein a circular protrusion, which projects toward the piston along the axial direction of the cylinder tube, is formed on an inner end surface of the first closure member, wherein one of the first port and the second port is provided on the inner circumferential wall of the cylinder tube at a position along an axial direction which at least partly overlaps the position along an axial direction of the projection of the circular protrusion, a concavity, which can be fitted externally over the circular protrusion, is formed on the piston, an annular groove is formed on an inner circumferential edge of the second closure member, wherein the other of the first port and the second port is provided on the inner circumferential wall of the cylinder tube at a position along an axial direction which at least partly overlaps the position along an axial direction of the annular groove, wherein by the piston coming into contact with the second closure member, a pressure receiving chamber is formed between the piston and the annular groove, together with an opening of the second port on an inner side of the cylinder tube being closed by the piston to a maximum of 90%, and by the piston coming into contact with the circular protrusion, another pressure receiving chamber is formed between the piston and the first closure member, together with an opening of the first port on the inner side of the cylinder tube being closed by the piston to a maximum of 90%.

2. The fluid pressure cylinder according to claim 1, wherein in a condition in which the piston contacts the second closure member, the opening of the second port on the inner side of the cylinder tube is 70% closed, and in a condition in which the piston contacts the circular protrusion, the opening of the first port on the inner side of the cylinder tube is 70% closed.

* * * * *